US007844207B2

(12) United States Patent
Ryo et al.

(10) Patent No.: US 7,844,207 B2
(45) Date of Patent: Nov. 30, 2010

(54) IMAGE FORMING APPARATUS INCLUDING BELT TRAVELING UNIT WHICH DETECTS DRIFITING OF BELT POSTION

(75) Inventors: Takemasa Ryo, Hitachinaka (JP); Satoru Tao, Hitachinaka (JP); Shinya Tomita, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 164 days.

(21) Appl. No.: 11/782,372

(22) Filed: Jul. 24, 2007

(65) Prior Publication Data

US 2008/0019736 A1 Jan. 24, 2008

(30) Foreign Application Priority Data

Jul. 24, 2006 (JP) ..... 2006-200262

(51) Int. Cl.
*G03G 15/01* (2006.01)

(52) U.S. Cl. ..... 399/302

(58) Field of Classification Search ..... 399/165, 399/302, 121, 126, 303, 308; 198/810.03, 198/807

See application file for complete search history.

(56) References Cited

U.S. PATENT DOCUMENTS 4,429,985 A 2/1984 Yokota
5,347,348 A 9/1994 Nagata
5,565,965 A 10/1996 Costanza et al.
2004/0126151 A1 7/2004 Asuwa et al.
2004/0129899 A1 * 7/2004 Gombert ..... 250/548

FOREIGN PATENT DOCUMENTS

JP 05-201578 8/1993
JP 2000-250375 9/2000
JP 2003-312885 11/2003
JP 2005-338522 12/2005

OTHER PUBLICATIONS

Machine Translation of JP2005-338522.*
U.S. Appl. No. 11/839,841, filed Aug. 16, 2007, Tao et al.
U.S. Appl. No. 12/104,127, filed Apr. 16, 2008, Tao et al.

* cited by examiner

*Primary Examiner*—David M Gray
*Assistant Examiner*—Gregory H Curran
(74) *Attorney, Agent, or Firm*—Oblon, Spivak, McClelland, Maier & Neustadt, L.L.P.

(57) ABSTRACT

A belt traveling unit includes an endless belt, a drive roller and a correction roller, a driving unit, a correction unit, a contact member, a position detector and a regulating member. The endless belt is spanned between a plurality of rollers. The driving unit rotates the drive roller to drive the belt. The correction unit adjusts a tilt angle of the correction roller to correct drifting of the belt in the width direction thereof. The contact member is rotatable in conjunction with traveling of the belt in the width direction thereof. The position detector detects a position of the contact member to detect a position of the belt in the width direction thereof. The regulating member is located at a position where the position detector does not misdetect the position of the belt when the contact member rotates.

26 Claims, 5 Drawing Sheets

IMAGE FORMING APPARATUS INCLUDING BELT TRAVELING UNIT WHICH DETECTS DRIFITING OF BELT POSTION

CROSS REFERENCE TO RELATED APPLICATIONS

This patent application is based on and claims priority under 35 U.S.C. §119 to Japanese patent application No. JP2006-200262 filed on Jul. 24, 2006 in the Japan Patent Office, the entire contents of which are incorporated herein by reference.

BACKGROUND OF THE INVENTION

1. Field of the Invention

The invention relates to a belt traveling unit, an image forming apparatus using the same, to a belt traveling unit which detects a position of a belt, an image forming apparatus including the same, and a method of forming an image.

2. Discussion of the Background

An image forming apparatus which forms not only a single color image, but also a multiple color image has been commonly used.

An image forming apparatus capable of forming a multiple color image includes a tandem-type color image forming apparatus.

The tandem-type color image forming apparatus may be equipped with a plurality of photoreceptor drums arranged along a spanned surface, for example, a belt, and directly transfers the color images formed on each of the respective color photoreceptor drums onto the belt. The photoreceptor drums may be in radial or at least partial circumferential contact with the belt. Accordingly, a multiple-color image is formed.

Alternatively, the tandem-type color image forming apparatus may sequentially overlay the color images formed on each of the respective color photoreceptor drums onto a recording sheet transported by the belt. Thereby, a multiple-color image is formed.

When using a belt, in a case where the tension balance is changed in a belt width direction, there may be such a problem that the belt may drift toward a roller around which the belt is wound or toward a shaft direction of a pulley.

When the belt is utilized as a transfer belt on which the toner image is directly transferred from the photoreceptor drum, instead of a belt used as a sheet conveyance purpose, when belt drift occurs, the positional misalignment or color misalignment of toner images of different colors may occur, thereby causing the quality of an image to deteriorate.

For this reason, ways to correct the drift of the transfer belt may be necessary.

In order to correct the drift of the transfer belt, a position detection mechanism and a drift correction mechanism have been proposed, for example.

The position detection mechanism may detect, for example, a position of the transfer belt in the width direction thereof.

Based on a detection signal from the position detection mechanism the drift correction mechanism may control a tilt angle of one of the rollers which support the transfer belt as a drift correction roller.

Accordingly, the transfer belt may be shifted in the width direction thereof, e.g., in response to the tilt angle control, so that the transfer belt returns to its reference position.

The technical difficulty of the drift correction may be to accurately detect the position of the edge of the transfer belt in the width direction without misdetection.

One example of a detection method for detecting the edge position of a belt in the width direction thereof will be described with reference to FIG. 1.

As shown in FIG. 1, the edge position detector at least includes a contact member 130, a spring 170 and a drift detector 150.

The contact member 130 is L-shaped, and the bent portion thereof has a spindle 140 which allows the contact member 130 to rotatively move around the spindle 140 along with the traveling motion of the transfer belt 100.

The spring 170 allows a vertical side 130*b* of the contact member 130 to abut the edge of the transfer belt 100.

The drift detector 150 is disposed facing a horizontal side 130*a* of the contact member 130 and serves as a detector which detects the belt position.

According to the above-described structure, when the contact member 130 moves in directions indicated by arrows C1 and C2, in accordance with a traveling motion of the transfer belt 100 in the width direction, the distance between the drift detector 150 and the portion 130*a* of the contact member 130 may change.

Accordingly, when the drift detector 150 detects the change in the distance, it is possible to detect the position of the transfer belt 100.

The amount of a detectable drift, that is, the traveling amount of the transfer belt 100 in the width direction may be determined by a distance Y which is a distance from the spindle 140 to the transfer belt 100, and a distance X which is a distance from the spindle 140 to the drift detector 150.

With reference to FIG. 2, there is shown an example of characteristics of the drift detector used as a position detector which detects the position of the transfer belt in the width direction.

In FIG. 2, a horizontal axis indicates a distance (mm) between the drift detector and an object to be measured. A vertical axis indicates an output voltage (V).

For example, when the drift detector 150 with the detection range of 2.0 mm is used, the detectable amount of the shift of the transfer belt 100 in the width direction may be 2.0 mm, where X equals Y (X=Y).

In this case, the ratio of X to Y is 1:1 (X:Y=1:1). Thus, the accuracy of the detection of the shift amount of the transfer belt 100 may be equal to the detection accuracy of the drift detector 150.

However, when using the drift detector with the detection range of 5.5 mm to detect the belt position located outside the range of the general use of the detection sensor, for example, the range less than 5.5 mm, the drift correction mechanism may misdetect the position of the transfer belt.

For example, when the position of the transfer belt is at 3.5 mm, the drift correction mechanism may misdetect the position to be at 5.0 mm.

Consequently, the drift correction of the transfer belt may not function properly, and thus the convergence time for recovering the transfer belt to its reference position may be extended. Furthermore, there may be a possibility that the transfer belt is damaged.

In light of the above, it is necessary to detect the amount of the shift of the belt in the width direction in a wide range. When the ratio of X to Y is 1:2, that is, X:Y=1:2, the shift amount of the transfer belt 100 may be 4.0 mm.

On the other hand, while detection in a wide range is made possible, the detection accuracy of the edge position of the transfer belt 100 may be reduced to half the detection accuracy of the drift detector 150.

Thus, the above method may not be desirable. In order to correct the drift of the transfer belt, the edge of the belt needs to be accurately detected.

Other structures for correcting the drift of the transfer belt have been proposed.

One example of such a structure allows the position of the transfer belt in the width direction to be detected within the range of the general use of the drift detector.

In addition, two drift detectors may be used to define the positional relationship of the two drift detectors so that the position of the transfer belt in the width direction may widely be detected, and thus the drift may be corrected.

However, when two drift detectors are used to detect the position of the transfer belt in the width direction, the cost may increase.

In addition, when detecting the belt position at the range less than 5.5 mm of the general use of the drift detector, there is a possibility that the detectors may misdetect the belt position due to characteristics of the drift detector.

SUMMARY

In view of the foregoing, exemplary embodiments of the present invention provide an image forming apparatus which includes a belt traveling unit.

In exemplary embodiments, the belt traveling unit may include at least an endless belt including a drive roller and a correction roller, a driving unit, a correction unit, a contact member, a position detector and a regulating member.

The endless belt may be spanned between a plurality of rollers. The driving unit the drive roller to drive the endless belt.

The correction unit may adjust a tilt angle of the correction roller to correct drifting of the belt in the width direction thereof.

The contact member may be rotatable in conjunction with traveling of the belt in the width direction thereof.

The position detector may detect a position of the contact member to detect a position of the belt in the width direction thereof.

The regulating member may be located at a position where the position detector does not misdetect the position of the belt when the contact member rotates.

In exemplary embodiments, the contact member and the regulating member may be integrated.

In exemplary embodiments, the regulating member and the contact member may be independently provided.

In exemplary embodiments, the regulating member may be movable such that a distance between the contact member and the position detector is adjustable.

In exemplary embodiments, the regulating member may be a screw.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
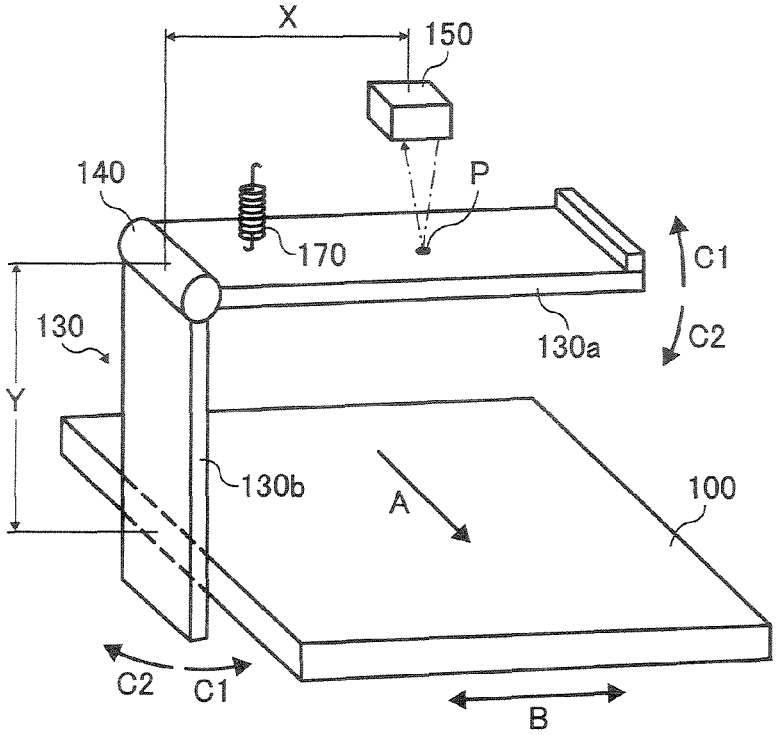
FIG. 1 is a schematic diagram illustrating a belt position detection unit of a belt traveling unit.
Figure 2:
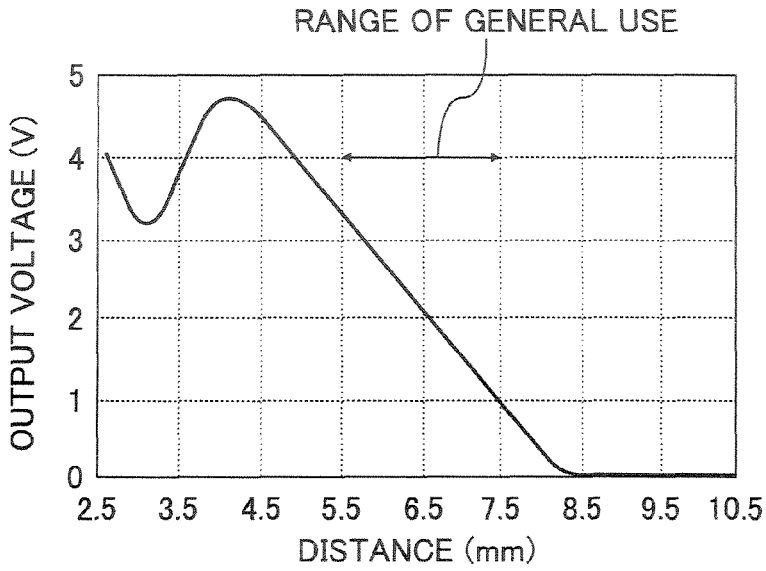
FIG. 2 is a graphical representation illustrating characteristics of a drift detector of the belt traveling unit of FIG. 1.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on", "directly connected to" or "directly coupled to" another element or layer, then there are no intervening elements or layers present. Like numbers refer to like elements throughout.

As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Exemplary embodiments of the present invention are now explained below with reference to the accompanying drawings.

In the later described comparative example, exemplary embodiment, and alternative example, for the sake of simplicity of drawings and descriptions, the same reference numerals will be given to constituent elements such as parts and materials having the same functions, and the descriptions thereof will be omitted unless otherwise stated.

Typically, but not necessarily, paper is the medium from which is made a sheet on which an image is to be formed. Other printable media is available in sheets and their use here is included.

For simplicity, this Detailed Description section refers to paper, sheets thereof, paper feeder, etc. It should be understood, however, that the sheets, etc., are not limited only to paper.

Figure 3:
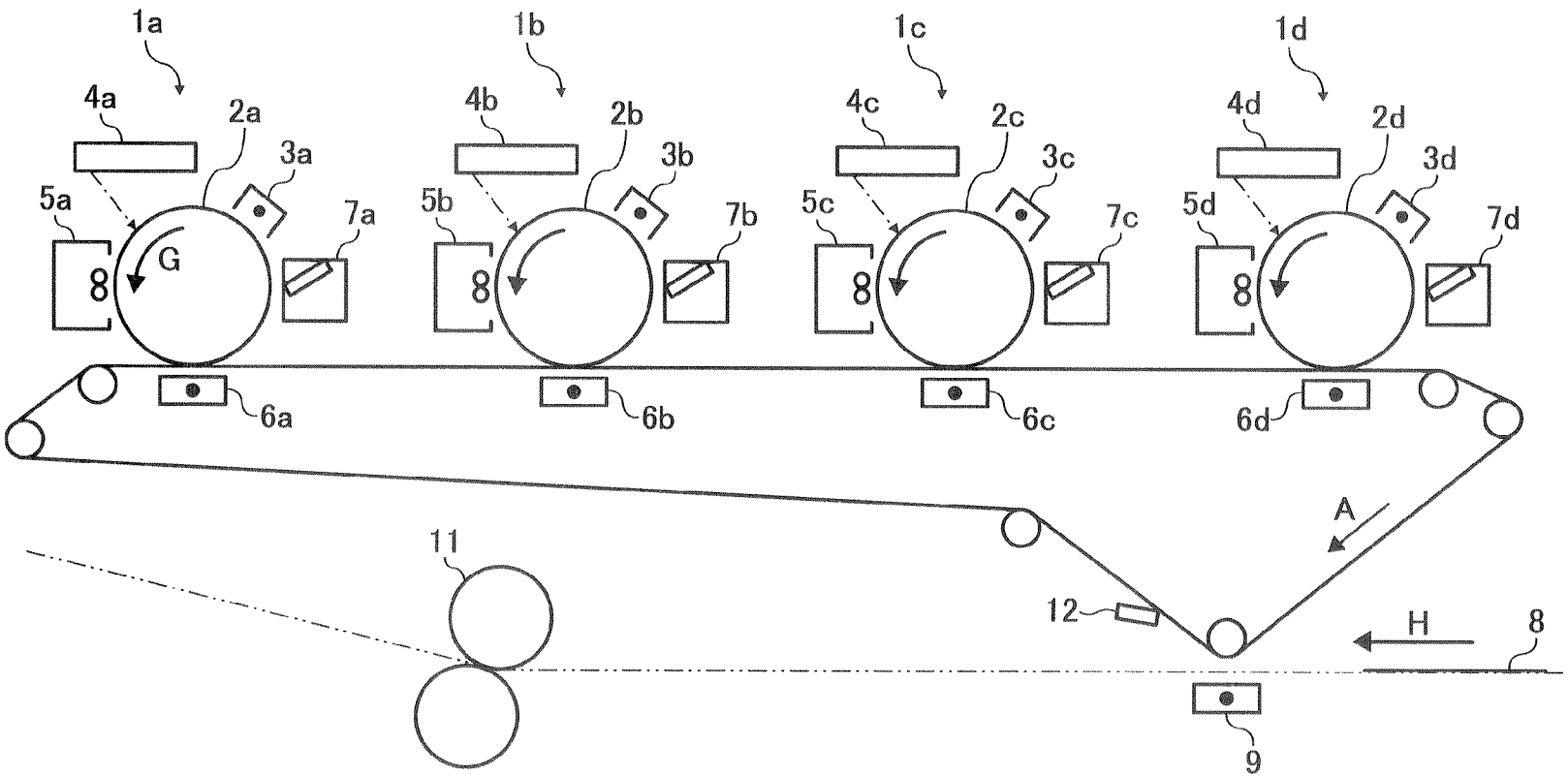
FIG. 3 is a schematic diagram illustrating an image forming apparatus, for example, a color-image forming apparatus according to an exemplary embodiment of the present invention.

Referring now to the drawings, wherein like reference numerals designate identical or corresponding parts throughout the several views, particularly to FIG. 3, a structure of an image forming apparatus, for example, a full-color image forming apparatus using a belt traveling unit according to an exemplary embodiment of the present invention is described.

Referring now to FIG. 3, there is shown a schematic diagram illustrating a full-color image forming apparatus using four colors, according to an exemplary embodiment of the present invention.

The image forming apparatus may include four image forming units 1*a*, 1*b*, 1*c* and 1*d* disposed along the traveling direction of a transfer belt 10.

The image forming unit 1*a* may include a photoreceptor drum 2*a*, a drum charging unit 3*a*, an exposure unit 4*a*, a developing unit 5*a*, a transfer unit 6*a* and a cleaning unit 7*a*.

Similar to the image forming unit 1*a*, the image forming units 1*b* through 1*d* may include a photoreceptor drum, a drum charging unit, an exposure unit, a developing unit, and a cleaning unit.

The letter symbols a, b, c, and d each indicate yellow, cyan, magenta and black, respectively. For example, the image forming unit 1*a* forms an image of yellow, 1*b* forms an image of cyan, and so forth.

When the photoreceptor drum 2*a* receives a signal initiating an image forming operation from a controller (not shown), the photoreceptor drum 2*a* starts to rotate in an arrow C direction and continues to rotate until the image forming operation is completed.

When the photoreceptor drum 2*a* starts to rotate, a high voltage is applied to the charging unit 3*a*. Accordingly, a negative charge is evenly applied to the surface of the photoreceptor drum 2*a*.

When character data or graphic data converted to a dot image is sent as an on/off signal of the exposure unit 4*a* to the image forming apparatus from the controller (not shown), there is a place on the photoreceptor drum 2*a* where a laser beam is irradiated by the exposure unit 4*a* and a place where no laser beam is irradiated.

Irradiated with the laser beam from the exposure unit 4*a*, when the place on the photoreceptor drum 2*a* where the charge is reduced reaches at a position opposite to the developing unit 5*a*, negatively-charged toner may adhere to the place on the photoreceptor drum 2*a* where the charge is reduced. Accordingly, a toner image is formed.

When the toner image formed on the photoreceptor drum 2*a* reaches at the transfer unit 6*a*, due to the high-voltage applied to the transfer unit 6*a*, the toner image is transferred onto the transfer belt 10 traveling in an arrow A direction.

After the photoreceptor drum 2*a* passes the transfer position, remnants such as the toner residue on the surface of the photoreceptor drum 2 are removed by the cleaning unit 7*a* so that the surface is cleaned for the subsequent image forming operation.

Subsequent to the image forming operation of the image forming unit 1*a*, an image forming operation is performed by the image forming unit 1*b* in a similar manner, if not the same, as the image forming operation performed by image forming unit 1*a*.

Due to the high-voltage applied to the transfer unit 6*b*, the toner image formed on the photoreceptor drum 2*b* is transferred onto the transfer belt 10.

At this time, with synchronization of the timing when the image transferred on the transfer belt 10 reaches at the transfer unit 6*b* with the timing when the toner image formed on the photoreceptor drum 2*b* is transferred to the transfer belt 10, the toner images formed by the image forming units 1*a* and 1*b* are overlaid on one another on the transfer belt 10.

Similarly, toner images formed by the image forming units 1*c* and 1*d* are overlaid on one another on the transfer belt 10 so that a full color image is formed on the transfer belt 10.

Subsequently, the full color image reaches at a sheet transfer unit 9. At the same time, a sheet 8 which is transported in a direction shown by an arrow H from the sheet feed unit of the image forming apparatus (not shown) reaches at the sheet transfer unit 9.

Due to the high-voltage applied to the sheet transfer unit 9, the full color image formed on the transfer belt 10 is transferred onto the sheet 8.

Subsequently, when the sheet 8 is transported to a fixing unit 11, the toner image on the sheet 8 is heat-fixed. After the full color image passes the sheet transfer unit 9, toner which has not been transferred adheres to the transfer belt 10. The toner is removed by another cleaning unit 12.

A description will now be given of the belt traveling unit used in one such embodiment of an image forming apparatus described above.

Figure 4:
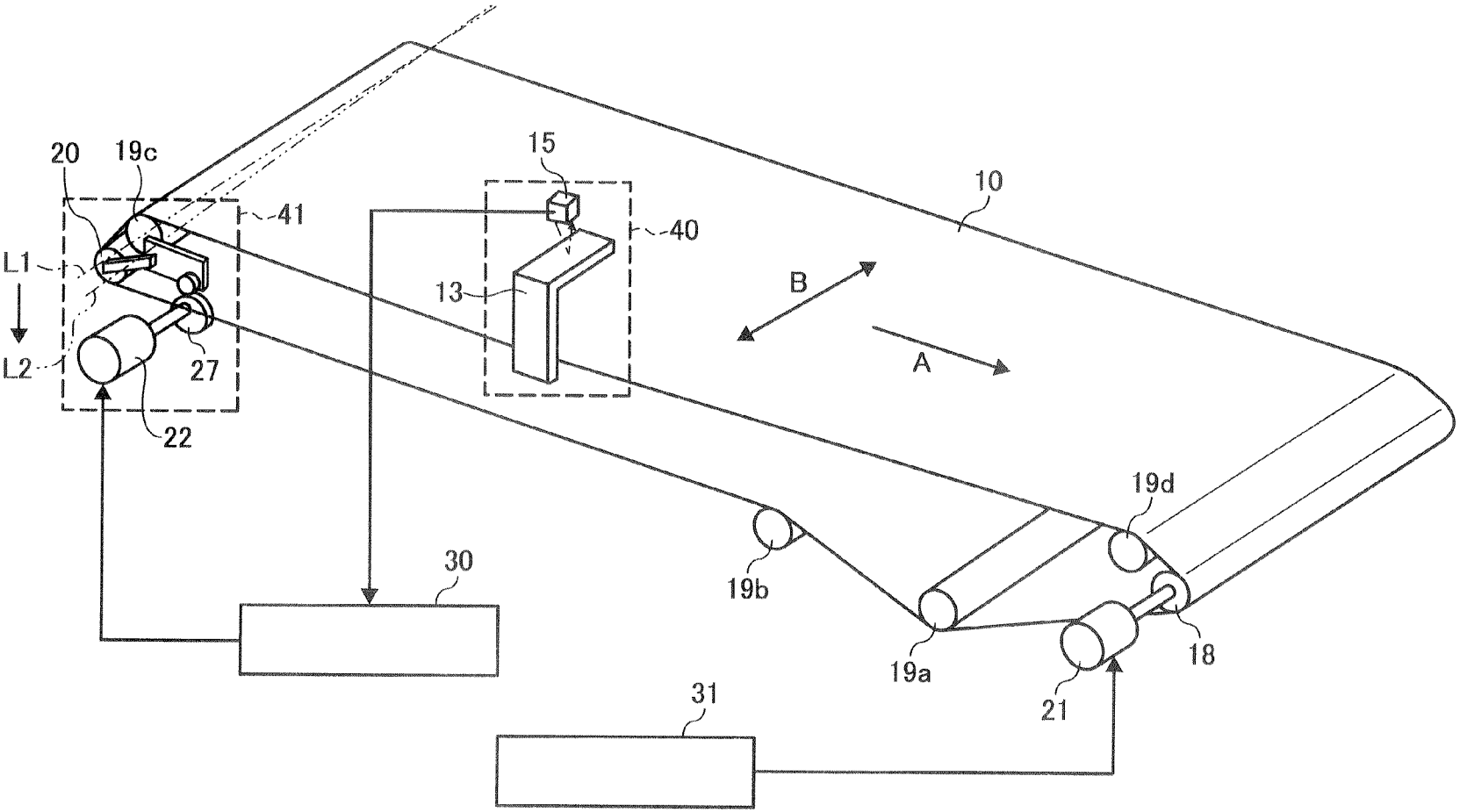
FIG. 4 is a schematic diagram illustrating a belt traveling unit according to an exemplary embodiment of the present invention.

FIG. 4 is a schematic diagram illustrating the belt traveling unit which drives the transfer belt 10 according to a first exemplary embodiment.

As shown in FIG. 4, the belt traveling unit may include the transfer belt 10, a position detection unit 40, a drift correction unit 41, drift correction control unit 30, a belt drive control unit 31 and so forth.

The transfer belt 10 is spanned, e.g., held and/or rotationally engaged, between a drive roller 18, a drift correction roller 20 and driven rollers 19*a* through 19*d*. The drive roller 18 is connected to a belt drive motor 21.

When the belt drive control unit 31 transmits a signal to control driving of the transfer belt 10, the belt drive motor 21 rotates so as to drive the transfer belt 10.

In FIG. 4, an arrow A indicates traveling direction of a belt. An arrow B indicates a belt width direction which is a direction perpendicular to the belt traveling direction A on a horizontal surface.

The position detection unit 40 may include a contact member 13 and a drift detector 15. The contact member 13 may come into contact with the belt edge. The drift detector 15 may serve as a detector for detecting the belt position.

The position detection unit 40 may detect the position of the edge of the transfer belt 10 in the width direction thereof so that an amount of drift of the transfer belt 10 in the belt width direction is detected. The detection signal of the drift detector 15 may be transmitted to the drift correction control unit 30.

The drift correction mechanism 41 may change a tilt angle of the drift correction roller 20 such that the drift of the transfer belt 10 may be corrected.

The amount of tilt of the drift correction roller 20 may be controlled based on the motor speed of a drift correction motor 22. The motor speed of the motor 22 may be determined by the drift correction control unit 30.

Figure 5:
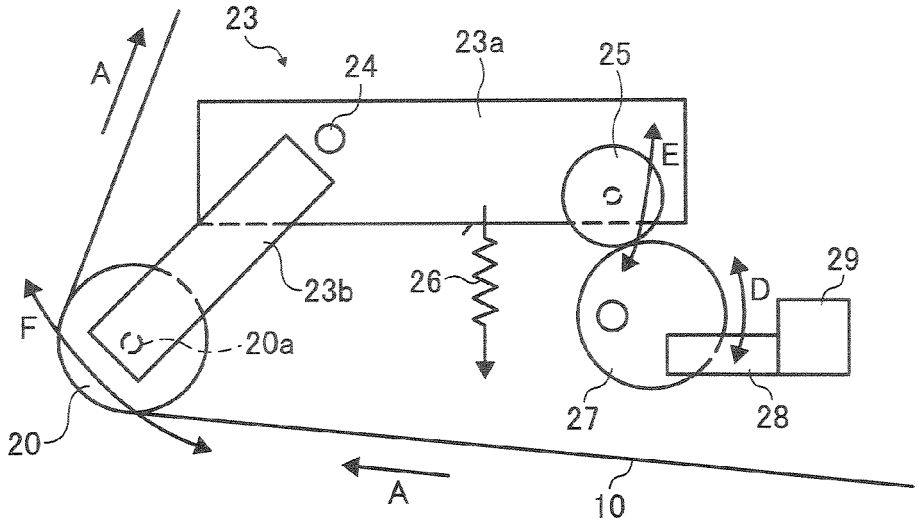
FIG. 5 is a schematic diagram illustrating a drift correction unit of the belt traveling unit according to an exemplary embodiment of the present invention.

Referring now to FIG. 5, a description will be given of an exemplary structure of the drift correction unit 41. The drift correction unit 41 may include a swing arm 23, an eccentric cam 27, a cam position detector 29 and so forth.

The swing arm 23 may include two swingable members 23*a* and 23*b* which are swingable in a relative direction with a rotary shaft 24 therebetween.

An end portion of the swingable member 23*b* may be disposed facing an end portion of the drift correction roller 20 and connected to the drift correction roller 20 in a manner such that the swingable member 23*b* may support a rotary shaft 20*a* of the drift correction roller 20. A bearing 25 may be fixed to an end portion of the swingable member 23*a*.

A spring 26 may be attached to the swing member 23*a* of the swing arm 23. By the pull tension of the spring 26, the bearing 25 is in contact with the eccentric cam 27.

The eccentric cam 27 may rotate around the rotary shaft provided at an eccentric position in an arrow D direction. The rotary shaft may be connected to the rotary shaft of the drift correction motor 22 shown in FIG. 4.

The cam position detector 29 may be disposed in the vicinity of the eccentric cam 27. The cam position detector 29 may be structured such that the reference position of the eccentric cam 27 may be recognized when the cam position detector 29 detects the position of a shield plate 28 provided to the eccentric cam 27.

Next, a description will be given of an exemplary operation of the drift correction unit 41. The drift correction control unit 30 may instruct the motor speed of the drift correction motor 22.

When the drift correction motor 22 rotates at a predetermined angle, the eccentric cam 27 may rotate in the arrow D direction shown in FIG. 5.

Accordingly, the bearing 25 which is in contact with the eccentric cam 27 may move up and down in an arrow E direction.

When the bearing 25 moves upward, causing one end of the swing member 23*a* to turn in the upward direction on the rotary shaft 24, the one end of the swing member 23*b* may turn in the downward direction on the rotary shaft 24.

The drift correction roller 20 is connected to the end portion of the swing member 23*b*. Thus, when the end portion of the swing member 23*b* turns downward, the drift correction roller 20 may move in a downward direction, that is, the direction shown by the arrow F in FIG. 5, accordingly.

As a result, the drift correction roller 20 with one shaft end thereof disposed at the swing member 23*b* may incline downward from a position L1 to a position L2.

On the contrary, when the bearing 25 moves downward, that is, in the upward direction shown by the arrow D in FIG. 5, the drift correction roller 20 may move upward in the direction shown by the arrow F.

In other words, because one end portion of the drift correction roller 20 may be fixed as shown in FIG. 4, and the other end thereof connected to the swing arm 23 may move up and down, one end of the drift correction roller 20 in the axis line direction may incline between the position L1 and the position L2.

When the drift correction roller 20 inclines, an area where friction does not evenly occur may be generated in a circumferential direction of the drift correction roller 20 around which the transfer belt 10 is spanned.

When the drift correction roller 20 moves downward, the transfer belt 10 may be dragged at an area where the friction contact is enhanced. Accordingly, the transfer belt 10 may move in the width direction in accordance with an amount of inclination of the drift correction roller 20.

Therefore, when the drift correction motor 22 controls the position of the eccentric cam 27, the tilt angle of the drift correction roller 20 may be changed so that the drift of the transfer belt 10 may be corrected.

Figure 6:
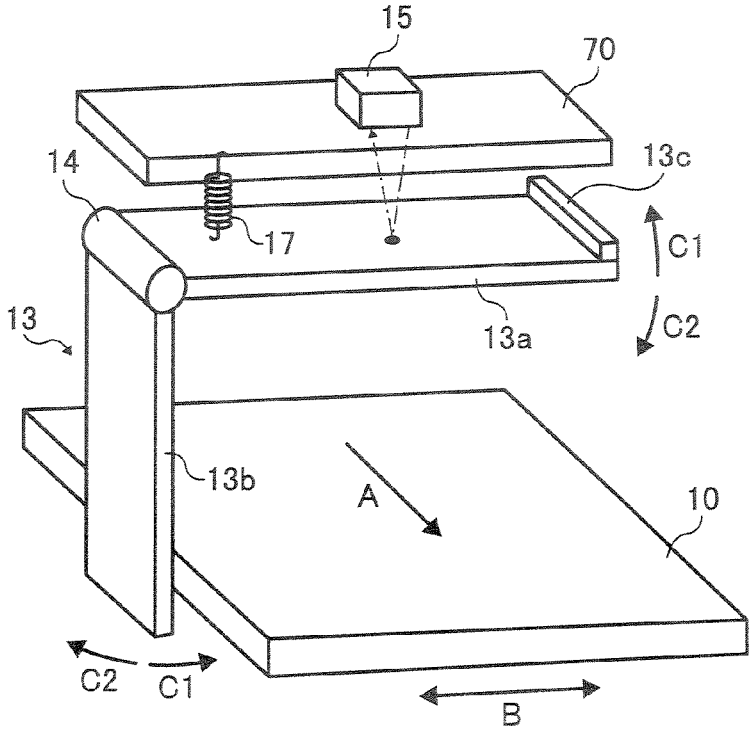
FIG. 6 is a schematic diagram illustrating a position detection unit of the belt traveling unit according to an exemplary embodiment of the present invention.

Referring now to FIG. 6 there is shown a schematic diagram illustrating the position detection unit 40 which may be utilized in the belt traveling unit.

In FIG. 6, the position detection unit 40 which detects the position of the transfer belt 10 in the width direction may include the contact member 13 having an angular shape, for example, an L-shape when looking from the traveling direction of the transfer belt 10, and the drift detector 15 serving as a belt position detector.

The contact member 13 may include a spindle 14, a horizontal side 13*a* which may hang down from the spindle 14, a vertical side 13*b* attached to the spindle 14, and a regulating member 13*c* disposed on the horizontal side 13*a* of the contact member 13 facing a bottom surface of a supporting member 70.

The horizontal side 13*a* and the vertical side 13*b* are rotatively supported on the spindle 14 in directions shown by the arrows C1 and C2.

A spring 17 is attached to the horizontal side 13*a* of the contact member 13. The spring tension thereof exerts a force to the vertical side 13*b* causing the vertical side 13*b* to come into contact with the edge of the transfer belt 10.

When the contact member 13 moves in conjunction with a traveling motion of the transfer belt 10 in the width direction, the regulating member 13*c* may come into contact with the supporting member 70 which supports the drift detector 15.

Thereby, the distance between the horizontal side 13*a* of the contact member 13 and the drift detector 15 may be regulated.

According to the exemplary embodiment, when the distance is less than 5.0 mm, there is a possibility that the drift correction control unit 30 shown in FIG. 4 may not correctly detect the distance.

Therefore, the distance between the horizontal side 13*a* and the drift detector 15 may be configured to be no less than 5.0 mm using the regulating member 13*c*.

In addition, rather than integrating the regulating member 13*c* with the contact member 13, the regulating member 13*c* may individually be provided to the contact member 13.

In a case where the distance between the horizontal side 13*a* and the drift detector 15 is misdetected in a structure using a plurality of drift detectors 15, the regulating member 13*c* may be provided so that misdetection of the distance may be prevented.

Furthermore, the drift detector 15 may be provided in the proximity of the horizontal side 13*a* of the contact member 13 in the longitudinal direction.

The detailed description of the drift detector 15 will be omitted herein. The drift detector 15 may include a light emitting portion and a light receiving portion, for example.

The light emitted from the light emitting portion is reflected on the object to measure. The drift detector 15 may detect the distance to the object based on the position of the reflected light received by the light receiving portion and the drift of the reference position.

The contact member 13 may rotate on the spindle 14. When the distance between the drift detector 15 and the horizontal side 13*a* of the contact member 13 changes, an analogue signal corresponding to the changes of the distance may be obtained.

The belt drift detection principle of the drift detector 15 may include a method or device in which the drift position may be detected by detecting the position of an incident light when the contact member 13 inclines.

According to the belt traveling unit of an exemplary embodiment, the regulating member 13*c* may be provided. Accordingly, the distance between the drift detector 15 and the horizontal side 13*a* of the contact member 13 may be no less than 5.0 mm.

Thereby, when the drift detector 15 detects the belt position, misdetection may be prevented.

In other words, the regulating member 13*c* may regulate the position of the contact member 13 such that the contact member 13 does not depart from the light receiving area which is the given detection characteristics of the drift detector 15.

Thereby, it is possible to eliminate a structure to detect the drift of the contact member 13 when the contact member 13 drifts out of the detection range of the drift detector 15.

Figure 7:
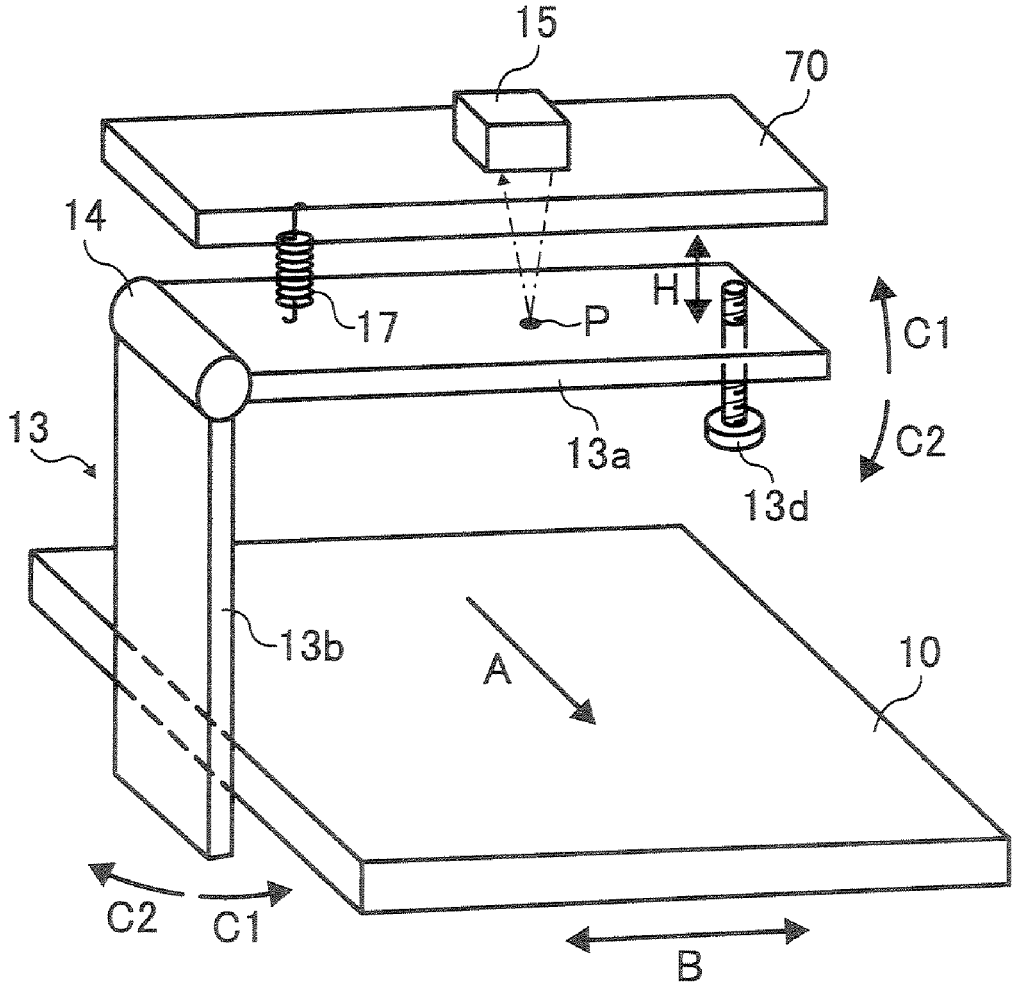
FIG. 7 is a schematic diagram illustrating a position detection unit of the belt traveling unit according to another exemplary embodiment of the present invention.

Referring now to FIG. 7 there is shown a schematic diagram illustrating the belt position detection unit 40 utilized in the belt traveling unit according to another exemplary embodiment (a second exemplary embodiment).

In the first exemplary embodiment, the distance between the drift detector 15 and the horizontal side 13*a* may be fixed to no less than 5.0 mm by the regulating member 13*c*.

In the second exemplary embodiment, a regulating member 13*d* may be used to adjust the distance between the drift detector 15 and the horizontal side 13*a* of the contact member 13 so as to be able to change the traveling amount of the contact member 13.

The regulating member 13*d* may be of a bolt or a screw or the like which may be adjustable.

In FIG. 7, the contact member 13 may be L-shaped with the horizontal side 13*a* and the vertical side 13*b*, and may be rotatively supported on the spindle 14.

According to the second embodiment, the regulating member 13*d* may move in a direction shown by an arrow H by fastening or unfastening the regulating member 13*d*.

When the contact member 13 moves in conjunction with traveling of the transfer belt 10 in the width direction thereof, the distance between the drift detector 15 and the horizontal side 13*a* of the contact member 13 may be adjusted in accordance with the position of the regulating member 13*d*. Thereby, the detection range of the belt position may be adjusted.

In addition, rather than integrating the regulating member 13*d* with the contact member 13, the regulating member 13*d* may individually be provided to the contact member 13.

In a case where the distance between the horizontal side 13*a* of the contact member 13 and the draft detector 15 may not correctly be detected in a structure using a plurality of drift detectors 15, the regulating member 13*d* may be provided so that misdetection of the distance may be prevented.

Further, elements and/or features of different exemplary embodiments may be combined with each other and/or substituted for each other within the scope of this disclosure and appended claims.

Still further, any one of the above-described and other exemplary features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

One or more embodiments of the present invention may be conveniently implemented using a conventional general purpose digital computer programmed according to the teachings of the present specification, as will be apparent to those skilled in the computer art.

Appropriate software coding can readily be prepared by skilled programmers based on the teachings of the present disclosure, as will be apparent to those skilled in the software art.

One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Furthermore, any of the aforementioned methods may be embodied in the form of a program. The program may be stored on a computer readable medium and is adapted to perform any one of the aforementioned methods, when run on a computer device (a device including a processor). The program may include computer executable instructions for carrying one or more of the steps above and/or one more aspects of the invention.

Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of a built-in medium include, but are not limited to, rewriteable non-volatile memories, such as ROMs and flash memories, and hard disks.

Examples of a removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited to any of the structure for performing the methodology illustrated in the drawings.

What is claimed is:

1. A belt traveling unit, comprising:

an endless belt in contact with and spanned between a plurality of rollers, the plurality of rollers including:
a drive roller; and
a correction roller, a driving unit that rotates the drive roller to drive the belt;

a correction unit that adjusts a tilt angle of the correction roller to correct drifting of the belt in a width direction of the belt;

a contact member that rotates in conjunction with traveling of the belt in the width direction;

a position detector that detects a position of the contact member to detect a position of the belt in the width direction; and a regulating member located at a position where the position detector does not misdetect the position of the belt when the contact member rotates, wherein the regulating member is an upwards projection out of a plane defined by the contact member and having a fixed height.

2. The belt traveling unit of claim 1, wherein the contact member and the regulating member are integrated with one another.

3. The belt traveling unit of claim 1, wherein the regulating member and the contact member are not the same part.

4. The belt traveling unit of claim 1, wherein the regulating member is movable such that a distance between the contact member and the position detector is adjustable.

5. The belt traveling unit of claim 4, wherein the regulating member is a screw.

6. An image forming apparatus, comprising:

a photoreceptor drum;

a charger that charges the photoreceptor drum;

an exposure unit that irradiates the photoreceptor drum with a laser beam to form an electrostatic latent image thereon;

an image developer that develops the electrostatic latent image with a developer comprising a toner to form a toner image on the photoreceptor drum;

a transfer unit that transfers the toner image onto a transfer material;

a fixing unit that fixes the toner image on the transfer material; and the belt traveling unit according to claim 1.

7. A method for forming an image, comprising:

transferring the toner image to the transfer medium of claim 6.

8. The method of claim 7, wherein the transfer medium is paper.

9. The belt traveling unit of claim 1, wherein the regulating member limits the travel of the contact member.

10. The belt traveling unit of claim 1, wherein the regulating member regulates the position of the contact member such that the contact member does not exceed a position detection limit of the position detector.

11. The belt traveling unit of claim 1, wherein the regulating member fixes the travel amount of the contact member.

12. The belt traveling unit of claim 1, wherein the regulating member is a bolt or a screw which may be adjusted to provide the fixed height.

13. The belt traveling unit of claim 1, wherein the regulating member is proximate to an end of a section of the contact member in a horizontal orientation with the endless belt.

14. The belt traveling unit of claim 1, wherein the contact member further comprises a spring connected to the contact member, wherein the spring and the regulating member are positioned at opposite ends of a portion of the contact member that is in horizontal orientation with the traveling belt.

15. The belt traveling unit of claim 1, wherein the contact member further comprises a spring means connected to the contact member, wherein the spring means and the regulating means are positioned at opposite ends of a portion of the contact member that is in horizontal orientation with the belt means.

16. The belt traveling unit of claim 1, wherein the contact member is comprises a horizontal portion and a vertical portion, wherein the vertical portion is in a vertical orientation to the endless belt and the horizontal portion is in a horizontal orientation to the endless belt, wherein the vertical portion of the contact member is held by a connecting member, and wherein rotation of the contact member about a fulcrum defined by the connecting member is restricted by the regulating member so that the contact member does not contact the correction unit when the contact member rotates about the fulcrum point in the direction of the correction unit.

17. The belt traveling unit of claim 1, wherein the regulating member restricts vertical movement of the contact member proximate to the correction unit in an orientation to a horizontal surface of the traveling belt responsive to horizontal movement of the traveling belt.

18. A belt traveling unit, comprising:

a belt means for contacting and spanning a plurality of rollers, the plurality of rollers including:
a drive roller; and
a correction roller, a driving means for rotating the drive roller and driving the belt;

a correcting means for adjusting a tilt angle of the correction roller and correcting a drift of the belt in a width direction of the belt;

a contact member that rotates in conjunction with traveling of the belt in the width direction;

a detecting means for detecting a position of the contact member and detecting a position of the endless belt in the width direction; and a regulating means for regulating the position of the contact member, by prohibiting free upwards travel of the contact member by a fixed height projection on the contact member, wherein the regulating means is located at a position where the detecting means does not misdetect the position of the belt when the contact member rotates.

19. An image forming apparatus, comprising:

a photoreceiving means for receiving an electrostatic latent image;

a charging means for charging the photoreceiving means;

an exposure means for irradiating the photoreceiving means and forming the electrostatic latent image on the photoreceiving means;

an image developing means for developing the electrostatic latent image and forming a toner image on the photoreceiving means;

a transferring means for transferring the toner image onto a transfer material;

a fixing means for fixing the toner image on the transfer material; and the belt traveling unit according to claim 18.

20. The belt traveling unit of claim 18, wherein the regulating means limits the travel of the contact member.

21. The belt traveling unit of claim 18, wherein the regulating means regulates the position of the contact member such that the contact member does not exceed a position detection limit of the position detector.

22. The belt traveling unit of claim 18, wherein the regulating means fixes the travel amount of the contact member.

23. The belt traveling unit of claim 18, wherein the regulating means includes a bolt or a screw which may be adjusted to provide the fixed height.

24. The belt traveling unit of claim 18, wherein the regulating means is proximate to an end of a section of the contact member in a horizontal orientation with the belt means.

25. The belt traveling unit of claim 18, wherein the regulating means for regulating the position of the contact member prohibits the contact member from contacting the correcting means.

26. The belt traveling unit of claim 18, wherein the regulating member restricts vertical movement of the contact member proximate to the correction unit in an orientation to a horizontal surface of the traveling belt responsive to horizontal movement of the traveling belt.

* * * * *

UNITED STATES PATENT AND TRADEMARK OFFICE

CERTIFICATE OF CORRECTION

PATENT NO. : 7,844,207 B2
APPLICATION NO. : 11/782372
DATED : November 30, 2010
INVENTOR(S) : Takemasa Ryo et al.

It is certified that error appears in the above-identified patent and that said Letters Patent is hereby corrected as shown below:

On the title page, Item (54), and column 1, the title is incorrect. Item (54) should read:

-- (54) IMAGE FORMING APPARATUS INCLUDING BELT TRAVELING UNIT WHICH DETECTS DRIFTING OF BELT POSITION --

Signed and Sealed this
First Day of February, 2011

David J. Kappos

David J. Kappos
*Director of the United States Patent and Trademark Office*